US010906093B2

(12) United States Patent
Barker

(10) Patent No.: US 10,906,093 B2
(45) Date of Patent: Feb. 2, 2021

(54) BELT CASTING PATH CONTROL

(71) Applicant: Novelis Inc., Atlanta, GA (US)

(72) Inventor: Simon William Barker, Woodstock, GA (US)

(73) Assignee: NOVELIS INC., Atlanta, GA (US)

( * ) Notice: Subject to any disclaimer, the term of this patent is extended or adjusted under 35 U.S.C. 154(b) by 117 days.

(21) Appl. No.: 15/999,068

(22) Filed: Aug. 16, 2018

(65) Prior Publication Data

US 2019/0054519 A1 Feb. 21, 2019

Related U.S. Application Data

(60) Provisional application No. 62/546,030, filed on Aug. 16, 2017.

(51) Int. Cl.
*B22D 11/06* (2006.01)
*B22D 11/16* (2006.01)
(Continued)

(52) U.S. Cl.
CPC ..... *B22D 11/0654* (2013.01); *B22D 11/0605* (2013.01); *B22D 11/0685* (2013.01);
(Continued)

(58) Field of Classification Search
CPC ..... B22D 11/0605; B22D 11/0654; B22D 11/0677; B22D 11/0685; B22D 11/168
See application file for complete search history.

(56) References Cited

U.S. PATENT DOCUMENTS 2,640,235 A 6/1953 Hazelett
3,193,888 A * 7/1965 Rochester ..... B22D 11/0654 164/432

(Continued)

FOREIGN PATENT DOCUMENTS

JP 02055644 A * 2/1990 ..... B22D 11/0685
SU 1114324 A 9/1984
WO 01/78922 10/2001

OTHER PUBLICATIONS

International Search Report and Written Opinion issued for Application No. PCT/IB2018/056186 dated Oct. 4, 2018 (11 pages).

(Continued)

*Primary Examiner* — Kevin E Yoon
(74) *Attorney, Agent, or Firm* — Kilpatrick Townsend & Stockton LLP

(57) ABSTRACT

A continuous casting device having multi-stage convergence control is disclosed. Cooling surfaces of the continuous casting device can be articulated in stages, providing individual convergence control to longitudinally spaced-apart regions of the casting cavity. In a proximal region, during which the molten metal exhibits solidification shrinkage, a first convergence profile can be used to optimally account for the solidification shrinkage. In a subsequent distal region, a second convergence profile can be used, such as to provide optimal control of exit temperature of the continuously cast article. Multi-stage convergence control can be achieved through individually articulatable cooling pads or other supports positioned opposite the cooling surfaces from the casting cavity to displace the cooling surfaces and thereby adjust the convergence profile of the casting cavity. Actuation of the individually articulatable cooling pads can effect different convergence profiles along the length of the continuous casting device.

17 Claims, 7 Drawing Sheets

(51) Int. Cl.
*B22D 11/12* (2006.01)
*B22D 11/124* (2006.01)

(52) U.S. Cl.
CPC ..... *B22D 11/1206* (2013.01); *B22D 11/1246* (2013.01); *B22D 11/168* (2013.01); *B22D 11/0677* (2013.01)

(56) References Cited

U.S. PATENT DOCUMENTS

| | | | | |
|---|---|---|---|---|
| 3,339,625 | A * | 9/1967 | Scherrer | B22D 11/0677 164/432 |
| 4,589,469 | A * | 5/1986 | Nelson | B22D 25/04 164/432 |
| 4,679,612 | A * | 7/1987 | Artz | B22D 11/0677 164/431 |
| 6,755,236 | B1 | 6/2004 | Sivilotti et al. | |
| 6,910,524 | B2 | 6/2005 | Sivilotti et al. | |
| 7,156,147 | B1 | 1/2007 | Wood et al. | |
| 7,823,623 | B2 | 11/2010 | Fitzsimon et al. | |
| 8,122,938 | B2 | 2/2012 | Luce et al. | |
| 8,579,012 | B2 | 11/2013 | Godin et al. | |
| 8,662,145 | B2 | 3/2014 | Gatenby et al. | |
| 8,813,826 | B2 | 8/2014 | Gatenby et al. | |
| 2007/0215314 | A1 | 9/2007 | Fitzsimon et al. | |

OTHER PUBLICATIONS

Russian Patent Application No. 2020110138, Office Action dated Oct. 16, 2020, 9 pages.

* cited by examiner

BELT CASTING PATH CONTROL

CROSS REFERENCE TO RELATED APPLICATIONS

The present application claims the benefit of U.S. Provisional Application No. 62/546,030 filed Aug. 16, 2017 and entitled "BELT CASTING PATH CONTROL," which is hereby incorporated by reference in its entirety.

TECHNICAL FIELD

The present disclosure relates to metal casting generally and more specifically to continuous casting using belt casting devices.

BACKGROUND

Certain continuous casting devices, such as belt casters, can be used to solidify molten metal as it passes between moving, cooling surfaces of the continuous casting device. In some cases, the cooling surfaces can be the surfaces of moving belts of a continuous belt caster.

Molten metal can be injected into the space between the belts and come into contact with the cooling surfaces. The cooling surfaces can extract heat from the molten metal to cause it to solidify. The cooling surfaces can be cooled from the sides opposite the molten metal by a cooling pad.

As the molten metal begins to solidify in the continuous casting device, the metal can shrink as it cools. For example, the metal may shrink in volume by approximately 6% as it cools. As the metal shrinks, it may pull away from the cooling surfaces. In some cases, metal pulling away from the cooling surfaces can result in a decrease in heat transfer between the metal and the cooling surfaces, which can permit the solidifying metal to reheat due to the latent heat within the metal. This reheating may result in surface defects, such as areas of surface exudation, which may be known as blebs. Surface defects can pose mechanical and/or metallurgical problems during the casting or subsequent metal processing steps. For example, in certain alloys, such as aluminum alloys, the eutectic compositions of the alloy may be the first portions to reheat, resulting in a localized region having a different chemical composition than the remainder of the cast metal article.

Continuous casting devices can have difficulty in producing a desirable surface of the cast metal article. Surface defects can result in waste (e.g., in cases where the cast metal article cannot be used) or the need for additional downstream processing (e.g., to correct or mitigate any correctable surface defects).

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

Examples of the present disclosure include a metal casting system comprising: an opposing pair of cooling assemblies defining a casting cavity therebetween, the casting cavity extending longitudinally between a proximal end and a distal end; and a nozzle positioned at the proximal end of the casting cavity for feeding molten metal into the casting cavity, wherein the opposing pair of cooling assemblies each comprise a cooling surface made of a thermally conductive material for extracting heat from the molten metal within the casting cavity to solidify the molten metal as the molten metal travels towards the distal end of the casting cavity; wherein each of the opposing pair of cooling assemblies includes: at least one proximal cooling pad positioned opposite the cooling surface from the casting cavity for displacing the cooling surface, wherein the at least one proximal cooling pad is longitudinally positioned adjacent to the proximal end of the casting cavity, and wherein the at least one proximal cooling pad is movable to adjust a convergence profile of the casting cavity in a proximal zone of the casting cavity; and at least one distal cooling pad positioned opposite the cooling surface from the casting cavity for displacing the cooling surface, wherein the at least one distal cooling pad is longitudinally positioned between the at least one proximal cooling pad and the distal end of the casting cavity.

In some cases, at least one distal cooling pad is movable to adjust a convergence profile of the casting cavity in a distal zone of the casting cavity between the proximal zone and a distal end of the casting cavity. In some cases, the at least one proximal cooling pad is pivotable to adjust the convergence profile of the casting cavity. In some cases, the at least one proximal cooling pad includes a plurality of proximal cooling pads, and wherein each of the plurality of proximal cooling pads is individually adjustable to adjust the convergence profile of the casting cavity. In some cases, the at least one proximal cooling pad is coupled to at least one actuator for adjusting the convergence profile of the casting cavity during a casting process. In some cases, the at least one proximal cooling pad includes a plurality of linear nozzles extending laterally across a width of the cooling surface. In some cases, each of the cooling surfaces is a continuous metal belt. In some cases, the at least one distal cooling pad is longitudinally spaced apart from the proximal end of the casting cavity by at least a distance at which the molten metal has solidified.

Further examples of the present disclosure include a continuous casting apparatus comprising: an opposing pair of cooling assemblies defining a casting cavity therebetween, the casting cavity extending longitudinally between a proximal end for accepting molten metal and a distal end for outputting solidified metal, wherein each of the cooling assemblies comprises a cooling surface made of a thermally conductive material for extracting heat from the molten metal to form the solidified metal, and wherein each of the cooling assemblies comprises: at least one proximal support positioned opposite the cooling surface from the casting cavity for displacing the cooling surface, wherein the at least one proximal support is longitudinally positioned adjacent to the proximal end of the casting cavity, and wherein the at least one proximal support is movable to adjust a convergence profile of the casting cavity in a proximal zone of the casting cavity; and at least one distal support positioned opposite the cooling surface from the casting cavity for displacing the cooling surface, wherein the at least one distal support is longitudinally positioned between the at least one proximal support and the distal end of the casting cavity.

In some cases, the at least one distal support is movable to adjust a convergence profile of the casting cavity in a distal zone of the casting cavity between the proximal zone and a distal end of the casting cavity. In some cases, the at least one proximal support is pivotable to adjust the convergence profile of the casting cavity. In some cases, the at least one proximal support includes a plurality of proximal supports, and wherein each of the plurality of proximal supports is individually adjustable to adjust the convergence profile of the casting cavity. In some cases, the at least one proximal support is coupled to at least one actuator for adjusting the convergence profile of the casting cavity during a casting process. In some cases, at least one of the at least one proximal support and the at least one distal support includes a cooling pad for extracting heat from the cooling surface. In some cases, each of the cooling surfaces is a continuous metal belt.

Further examples of the present disclosure include a method of continuous casting comprising: providing molten metal to a casting cavity between an opposing pair of cooling assemblies at a proximal end of the casting cavity; extracting heat from the molten metal to solidify the molten metal into a solidified metal exiting at a distal end of the casting cavity; adjusting a convergence profile of the casting cavity at a proximal region, wherein the proximal region is adjacent the proximal end of the casting cavity; and adjusting the convergence profile of the casting cavity at a distal region, wherein the distal region is located between the proximal region and a distal end of the casting cavity.

In some cases, adjusting the convergence profile of the casting cavity at the proximal region includes adjusting, for each of the opposing pair of cooling assemblies a proximal angle of attack of a cooling surface of the cooling assembly, wherein the proximal angle of attack defines an orientation of the cooling surface with respect to a centerline of the casting cavity at the proximal region; and adjusting the convergence profile of the casting cavity at the distal region includes adjusting, for each of the opposing pair of cooling assemblies, a distal angle of attack of the cooling surface of the cooling assembly, wherein the distal angle of attack defines an orientation of the cooling surface with respect to a centerline of the casting cavity at the distal region. In some cases, adjusting the convergence profile of the casting cavity at the proximal region includes, for each of the opposing pair of cooling assemblies, moving at least one proximal support, wherein moving the at least one proximal support displaces a cooling surface of the cooling assembly to adjust the convergence profile of the casting cavity at the proximal region; and adjusting the convergence profile of the casting cavity at the distal region includes, for each of the opposing pair of cooling assemblies, moving at least one distal support, wherein moving the at least one distal support displaces the cooling surface of the cooling assembly to adjust the convergence profile of the casting cavity at the distal region. In some cases, the method further comprises determining a desired casting profile, wherein determining the desired casting profile is based on at least one casting parameter, and wherein adjusting the convergence profile of the casting cavity at the proximal region includes using the desired casting profile. In some cases, adjusting the convergence profile of the casting cavity at the proximal region occurs during a casting process.

In any of the aforementioned cases, the molten metal can be an aluminum alloy. In some cases, the aluminum alloy can have a Magnesium content at or above 8% by weight based on the total weight of the alloy. In some cases, the Magnesium content is at or above 8.5% by weight. In some cases, the Magnesium content is at or above 9% by weight. In some cases, the Magnesium content is at or above 9.6% by weight.

Also disclosed is a continuously cast article made according to the aforementioned methods and/or using the aforementioned systems or apparatuses.

Other objects and advantages will be apparent from the following detailed description of non-limiting examples.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
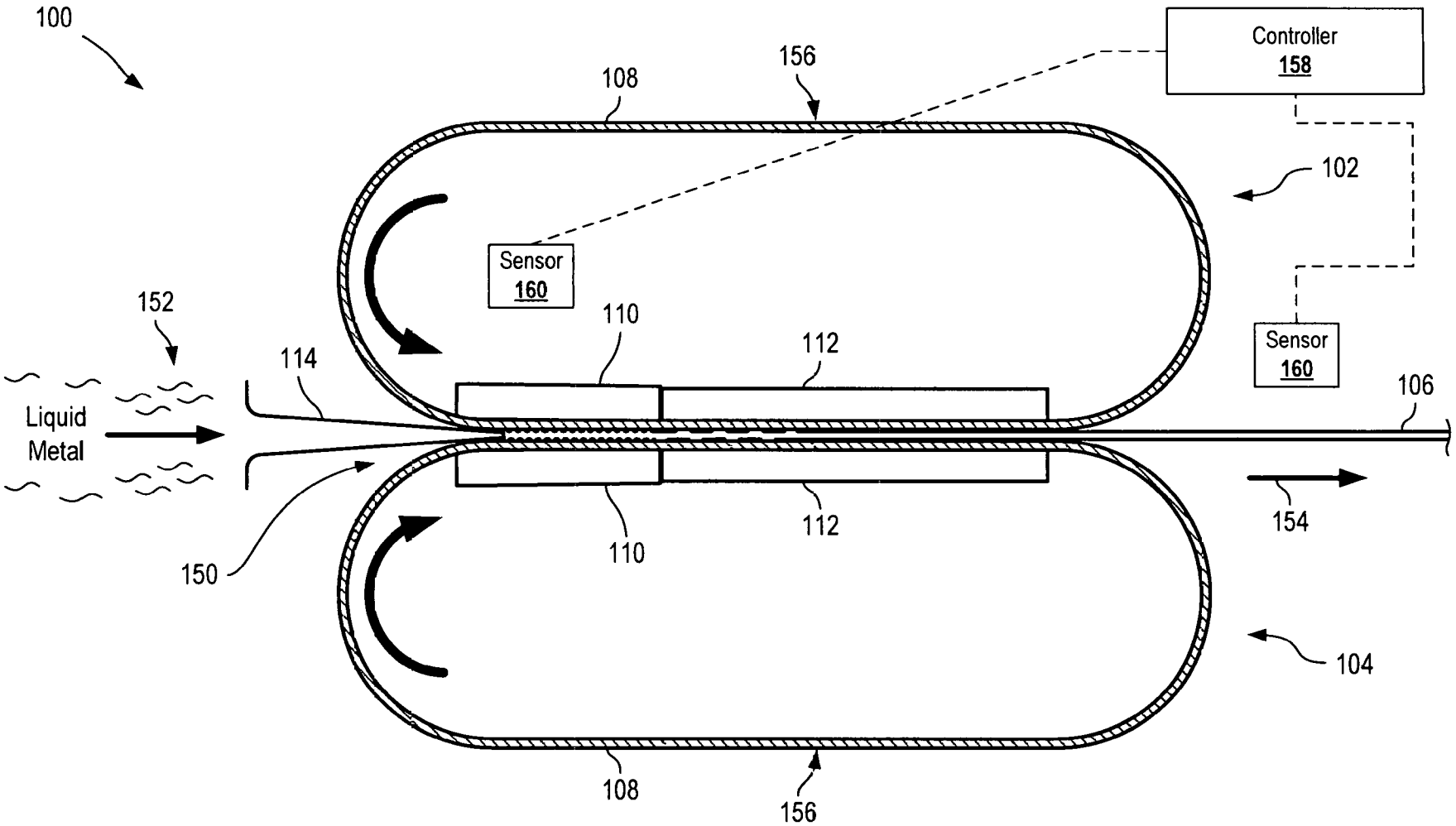
FIG. 1 is a side view schematic diagram depicting a continuous casting device according to certain aspects of the present disclosure.

Certain aspects and features of the present disclosure relate to a continuous casting device having multi-stage convergence control. The moving, cooling surfaces of the continuous casting device can be articulated in multiple stages to provide individual convergence control to longitudinally spaced-apart regions of the casting cavity. In a first (e.g., proximal) region, during which the molten metal exhibits solidification shrinkage, a first convergence profile (e.g., having a first rate of convergence) can be used to optimally account for the solidification shrinkage. In a second (e.g., distal) region, after the first region, a second convergence profile (e.g., having a second rate of convergence) can be used, such as to provide optimal control of the exit temperature of the continuously cast article. Multi-stage convergence control can be achieved through individually articulatable cooling pads positioned opposite the cooling surfaces from the casting cavity. Actuation of the individually articulatable cooling pads can effect different convergence profiles along the length of the continuous casting device.

As used herein, the meaning of "a," "an," and "the" includes singular and plural references unless the context clearly dictates otherwise. As used herein, the terms "top" and "bottom" can be associated with vertical positions when the continuous casting device is casting in a horizontal direction. However, in some cases, the continuous casting device may be used in a non-horizontal direction, in which case the terms "top" and "bottom" may refer to positions in a plane perpendicular to the casting direction of the continuous casting device.

A continuous caster or continuous casting device can include a pair of opposing cooling assemblies forming a casting cavity therebetween. In some cases, additional features, such as side dams, can further define the extent of the casting cavity. Each cooling assembly can include at least one cooling surface for extracting heat from molten metal within the casting cavity, as well as additional equipment related to operation of the cooling surface or cooling assembly (e.g., cooling pads, motors, coolant piping, sensors, and other such equipment).

Some continuous casters, such as belt casters, can consist of two counter-rotating belts (e.g., opposing cooling surfaces) that, along with side dams, form a casting cavity into which molten metal can be fed. The belts can be water-cooled (e.g., cooled with deionized water) or cooled using other fluids. Molten metal entering the casting cavity at an entrance to the casting cavity can solidify, through heat extraction via the cooled belts, as it moves distally towards the exit of the casting cavity, where it exits as solidified metal (e.g., a continuously cast article). The metal can move through the casting device at approximately the same rate of movement of the belts, thus minimizing or eliminating shear forces between the solidifying metal and the belts.

As the metal cools and solidifies, it can shrink in volume. For example, Aluminum may shrink approximately 6-7% by volume, which is known as solidification shrinkage. Solidification shrinkage may occur over the first 200 mm to 300 mm from the location where the molten metal comes into contact with the belts, although it may occur over other ranges, as well, including sub-ranges of 200 mm-300 mm. If the casting cavity were parallel (e.g., having parallel belts, or zero convergence rate), the solidifying metal may lose contact with the cooled belts, particularly the top belt, at which point the heat transfer coefficient for extracting heat from the solidifying metal may rapidly decrease significantly (e.g., by orders of magnitude). This loss of contact can lead to undesirable effects, such as surface reheating, re-melting, or surface exudation. Current convergence control techniques can be used to control exit temperature and thickness of the as-cast metal article, however they do not account for the shrinkage during solidification. These current convergence control techniques often involve tilting the moving metal belts, as well as its driving apparatus, such that the cooling surfaces of the top and bottom belts at the casting cavity lie in intersecting planes which intersect at a point distal of the casting cavity. In other words, the height of the casting cavity decreases at a constant rate (e.g., constant rate of convergence) from the proximal end to the distal end of the casting cavity. However, certain aspects of the present disclosure can provide multi-stage convergence control, capable of accounting for solidification shrinkage, while also performing the other aspects of current dynamic convergence control techniques. This multi-stage convergence control can achieve dynamic rates of convergence along the length of the casting cavity, thus effecting a convergence cavity with multiple convergence profiles.

In some cases, this multi-stage convergence control can be achieved through cooling pads positioned opposite the cooling surfaces (e.g., continuous belts) from the casting cavity. In some cases, the cooling pads can be adjusted before a casting process and secured in place. In some cases, the cooling pads can be pre-formed to achieve a multi-stage convergence profile. In such cases, the cooling pads may or may not be movable.

In some cases, the cooling pads can be actuated by any suitable actuator, such as a linear actuator like a motor-driven, hydraulic, pneumatic, or other type of actuator. In some cases, each cooling pad can pivot about a pivot point or fulcrum to effect the desired convergence profile in the casting cavity by adjusting the contour of at least one of the cooling belts. In some cases, the actuator can be adjustable during the casting process. In some cases, the actuator can be dynamically adjustable during the casting process based on sensor feedback. The actuator can be coupled to a controller that can receive sensor data and make a determination with respect to the position of one or more of the cooling pads to achieve a desired result. For example, a temperature sensor coupled to the controller can provide information about temperatures within the casting cavity, on the cooling surfaces, and/or on the continuously cast article exiting the casting cavity. These temperatures can be used to determine if one or more of the cooling pads should be moved or adjusted to maintain or achieve a desired surface quality. Other sensors can be used.

In some cases, the cooling pads can include multiple nozzles located along a surface of the cooling pad and arranged in a pattern, such as a hexagonal or other pattern. In some cases, a cooling pad can include at least one linear nozzle extending across the width of the cooling pad and/or substantially or entirely across a width of the casting cavity.

Control of a cooling surface's contour, and thus the convergence profile of the casting cavity, is described herein with reference to the use of cooling pads to apply pressure to displace the cooling surface (e.g., continuous belt). However, in some cases, an alternate support other than a cooling pad can be used, such as a low-friction surface (e.g., Teflon-coated surface) or a moving surface (e.g., an articulatable roller).

Certain aspects and features of the present disclosure can be especially suitable for continuous belt casting devices, in which the cooling surfaces of opposing cooling assemblies are continuous metal belts that move with the solidifying metal in the casting cavity during casting. For clarity and illustrative purposes, certain aspects of the present disclosure will be described with reference to a continuous belt caster, however these aspects may be applicable to other continuous casting devices, as appropriate.

The multi-articulated design as disclosed herein allows a cooling surface of a continuous casting device to remain in constant or substantially constant contact with the solidifying surface of the metal within the casting device. Certain aspects and features of the present disclosure include, for each cooling belt, multiple cooling pads or other articulatable surfaces capable of adjusting the distance between the cooling belt and the center of the casting cavity. Since cooling pads can be used to extract heat from the cooling belt, it can be advantageous to use multiple articulating or actuatable cooling pads to effect the different rates of convergence of the cooling belt along the length of the casting cavity. The multiple cooling pads or other articulatable surfaces allow the convergence profile of the casting cavity to be separately adjusted in a first region and a second region, such as a proximal region and a distal region. Multiple cooling pads can be separately adjusted to achieve a steeper convergence rate in a proximal region (e.g., a first region at or near the molten metal entrance to the casting cavity) to account for the relatively higher rate of contraction in that region and to achieve a shallower convergence rate in a distal region (e.g., a second region at or near the solidified metal exit of the casting cavity) to account for the relatively lower rate of contraction in that region. Thus, a risk of undesirable surface-related defects can be minimized.

Certain aspects of the present disclosure can improve as-cast surface quality of a continuously cast metal article. Any suitable metal can be used, however certain aspects of the present disclosure are especially suitable for casting aluminum alloys. In some cases, certain aspects of the present disclosure are especially suitable for casting aluminum alloys having high magnesium content (e.g., at or above 8%, 8.2%, 8.4%, 8.6%, 8.8%, 9%, 9.2%, 9.4% or 9.6% Mg by weight), and can help inhibit or eliminate the forming of beta film, at least at or near the surface of the continuously cast article.

The continuously cast article can have any suitable thickness, determined at least in part by the size of the casting cavity between the cooling surfaces of the continuous caster. The continuously cast article can be a metal strip, although the continuously cast article may be of other sizes (e.g., plate or shate).

As used herein, a plate generally has a thickness of greater than about 15 mm. For example, a plate may refer to an aluminum product having a thickness of greater than 15 mm, greater than 20 mm, greater than 25 mm, greater than 30 mm, greater than 35 mm, greater than 40 mm, greater than 45 mm, greater than 50 mm, or greater than 100 mm.

As used herein, a shate (also referred to as a sheet plate) generally has a thickness of from about 4 mm to about 15 mm. For example, a shate may have a thickness of 4 mm, 5 mm, 6 mm, 7 mm, 8 mm, 9 mm, 10 mm, 11 mm, 12 mm, 13 mm, 14 mm, or 15 mm.

As used herein, a sheet generally refers to an aluminum product having a thickness of less than about 4 mm. For example, a sheet may have a thickness of less than 4 mm, less than 3 mm, less than 2 mm, less than 1 mm, less than 0.5 mm, less than 0.3 mm, or less than 0.1 mm.

Certain aspects of the present disclosure relate to a continuous casting device having multiple-stage convergence control. In some cases, the number of convergence stages is two, although more than two stages can be used. A first, or proximal, stage can be adjustable to account for the shrinkage of the molten metal entering the continuous caster as it first solidifies. An additional, or distal, stage can be adjustable to control removal of the sensible heat, thereby controlling the exit temperature from the continuous caster.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

The continuously cast article can be processed by any means known to those of ordinary skill in the art. Such processing steps include, but are not limited to, homogenization, hot rolling, cold rolling, solution heat treatment, and an optional pre-aging step.

Optionally, the continuously cast article can be allowed to cool to a temperature between 300° C. to 450° C. For example, the continuously cast article can be allowed to cool to a temperature of between approximately 325° C. to approximately 425° C. or from approximately 350° C. to approximately 400° C. The continuously cast article can then be hot rolled at a temperature between approximately 300° C. to approximately 450° C. to form a hot rolled plate, a hot rolled shate or a hot rolled sheet having a gauge between 3 mm and 200 mm (e.g., 3 mm, 4 mm, 5 mm, 6 mm, 7 mm, 8 mm, 9 mm, 10 mm, 15 mm, 20 mm, 25 mm, 30 mm, 35 mm, 40 mm, 45 mm, 50 mm, 55 mm, 60 mm, 65 mm, 70 mm, 75 mm, 80 mm, 85 mm, 90 mm, 95 mm, 100 mm, 110 mm, 120 mm, 130 mm, 140 mm, 150 mm, 160 mm, 170 mm, 180 mm, 190 mm, 200 mm, or anywhere in between). During hot rolling, temperatures and other operating parameters can be controlled so that the temperature of the hot rolled intermediate product upon exit from the hot rolling mill is no more than approximately 470° C., no more than approximately 450° C., no more than approximately 440° C., or no more than approximately 430° C.

In some cases, the plate, shate or sheet can then be cold rolled using conventional cold rolling mills and technology into a sheet. The cold rolled sheet can have a gauge between about 0.5 to 10 mm, e.g., between about 0.7 to 6.5 mm. Optionally, the cold rolled sheet can have a gauge of 0.5 mm, 1.0 mm, 1.5 mm, 2.0 mm, 2.5 mm, 3.0 mm, 3.5 mm, 4.0 mm, 4.5 mm, 5.0 mm, 5.5 mm, 6.0 mm, 6.5 mm, 7.0 mm, 7.5 mm, 8.0 mm, 8.5 mm, 9.0 mm, 9.5 mm, or 10.0 mm. The cold rolling can be performed to result in a final gauge thickness that represents a gauge reduction of up to 85% (e.g., up to 10%, up to 20%, up to 30%, up to 40%, up to 50%, up to 60%, up to 70%, up to 80%, or up to 85% reduction). Optionally, an interannealing step can be performed during the cold rolling step. The interannealing step can be performed at a temperature of from about 300° C. to about 450° C. (e.g., about 310° C., about 320° C., about 330° C., about 340° C., about 350° C., about 360° C., about 370° C., about 380° C., about 390° C., about 400° C., about 410° C., about 420° C., about 430° C., about 440° C., or about 450° C.). In some cases, the interannealing step comprises multiple processes. In some non-limiting examples, the interannealing step includes heating the plate, shate or sheet to a first temperature for a first period of time followed by heating to a second temperature for a second period of time. For example, the plate, shate or sheet can be heated to about 410° C. for about 1 hour and then heated to about 330° C. for about 2 hours.

Subsequently, the plate, shate or sheet can undergo a solution heat treatment step. The solution heat treatment step can be any conventional treatment for the sheet which results in solutionizing of the soluble particles. The plate, shate or sheet can be heated to a peak metal temperature (PMT) of up to about 590° C. (e.g., from about 400° C. to about 590° C.) and soaked for a period of time at the temperature. For example, the plate, shate or sheet can be soaked at about 480° C. for a soak time of up to about 30 minutes (e.g., 0 seconds, 60 seconds, 75 seconds, 90 seconds, 5 minutes, 10 minutes, 20 minutes, 25 minutes, or 30 minutes).

After heating and soaking, the plate, shate or sheet is rapidly cooled at rates greater than about 200° C./s to a temperature between approximately 500 and 200° C. In one example, the plate, shate or sheet has a quench rate of above 200° C./second at temperatures between approximately 450° C. and 200° C. Optionally, the cooling rates can be faster in other cases.

After quenching, the plate, shate or sheet can optionally undergo a pre-aging treatment by reheating the plate, shate or sheet before coiling. The pre-aging treatment can be performed at a temperature of from about 70° C. to about 125° C. for a period of time of up to 6 hours. For example, the pre-aging treatment can be performed at a temperature of about 70° C., about 75° C., about 80° C., about 85° C., about 90° C., about 95° C., about 100° C., about 105° C., about 110° C., about 115° C., about 120° C., or about 125° C. Optionally, the pre-aging treatment can be performed for about 30 minutes, about 1 hour, about 2 hours, about 3 hours, about 4 hours, about 5 hours, or about 6 hours. The pre-aging treatment can be carried out by passing the plate, shate or sheet through a heating device, such as a device that emits radiant heat, convective heat, induction heat, infrared heat, or the like.

The cast products described herein can also be used to make products in the form of plates or other suitable products. For example, plates including the products as described herein can be prepared by casting a product in a continuous caster as disclosed herein followed by a hot rolling step. In the hot rolling step, the cast product can be hot rolled to a 200 mm thick gauge or less (e.g., from about 10 mm to about 200 mm). For example, the cast product can be hot rolled to a plate having a final gauge thickness of about 10 mm to about 175 mm, about 15 mm to about 150 mm, about 20 mm to about 125 mm, about 25 mm to about 100 mm, about 30 mm to about 75 mm, or about 35 mm to about 50 mm.

The aluminum alloy products described herein can be used in automotive applications and other transportation applications, including aircraft and railway applications, or any other suitable application. For example, the disclosed aluminum alloy products can be used to prepare automotive structural parts, such as bumpers, side beams, roof beams, cross beams, pillar reinforcements (e.g., A-pillars, B-pillars, and C-pillars), inner panels, outer panels, side panels, inner hoods, outer hoods, or trunk lid panels. The aluminum alloy products and methods described herein can also be used in aircraft or railway vehicle applications, to prepare, for example, external and internal panels.

The aluminum alloy products and methods described herein can also be used in electronics applications. For example, the aluminum alloy products and methods described herein can be used to prepare housings for electronic devices, including mobile phones and tablet computers. In some examples, the aluminum alloy products can be used to prepare housings for the outer casing of mobile phones (e.g., smart phones), tablet bottom chassis, and other portable electronics.

These illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may not be drawn to scale. Specifically, the angles of attack illustrated herein have been exaggerated for illustrative purposes.

FIG. 1 is a side view schematic diagram depicting a continuous casting device 100 according to certain aspects of the present disclosure. The continuous casting device 100 includes a top belt assembly 102 and a bottom belt assembly 104 between which a casting cavity 150 is located. Each of the top belt assembly 102 and the bottom belt assembly 104 can include a cooling belt 108, a proximal support 110, and a distal support 112. In some cases, proximal support 110 can be a proximal cooling pad, which is used to extract heat from the cooling belt 108. In some cases, distal support 112 can be a distal cooling pad, which is used to extract heat from the cooling belt 108. In cases where the proximal support 110 and/or the distal support 112 are not cooling pads, heat extracting from the cooling belt 108 can be achieved using other cooling elements, such as coolant nozzles, spray bars, or any other suitable cooling element. As used herein, the term "proximal" with reference to cooling pads, supports, or the like can refer to structures positioned at or near an entrance to the casting cavity 150, such as where molten metal enters the casting cavity 150. As used herein, the term "distal" with reference to cooling pads, supports, or the like can refer to structures positioned at or near an exit of the casting cavity 150, such as where solidified metal exits the casting cavity 150.

While FIG. 1 depicts a single proximal support 110 and a single distal support 112 for each of the top belt assembly 102 and bottom belt assembly 104, other numbers of supports or cooling pads can be used. In some cases, the proximal support 110 and/or distal support 112 can each comprise a plurality of supports and/or cooling pads, which can be configured to achieve a two-stage convergence profile. In some cases, additional supports (e.g., additional cooling pads) can be positioned between the proximal support 110 and distal support 112 to provide additional stages to the convergence profile, such as to achieve a three or more stage convergence profile.

The belt 108 can be made of any suitable thermally-conductive material, such as copper, steel, or aluminum. The belts 108 of the top belt assembly 102 and the bottom belt assembly 104 can rotate in opposite directions to one another, such that the surfaces of the belts 108 that come into contact with the liquid metal 152 in the casting cavity 150 move in a downstream direction 154. The top belt assembly 102 and the bottom belt assembly 104 can further include additional equipment as necessary, such as motors and other equipment.

Liquid metal 152 can enter the casting cavity 150 via nozzle 114. Within the casting cavity 150, the liquid metal 152 can solidify as heat is extracted via the belts 108 of the top belt assembly 102 and the bottom belt assembly 104. The liquid metal 152 and solidifying liquid metal 152 move in direction 154 within the casting cavity. After sufficient heat has been extracted, the liquid metal 152 will have become solid and can exit the casting cavity 150 as a continuously cast article 106. The continuously cast article 106 will exit the continuous casting device 100 at an exit temperature.

The casting cavity 150 is bounded by an entrance (e.g., at the nozzle 114), an exit (e.g., where the continuously cast article 106 exits the casting cavity 150), side dams, the top belt assembly 102, and the bottom belt assembly 104. More specifically, because the belts 108 of the top and bottom belt assemblies 102, 104 are in motion, the top and bottom of the casting cavity 150 are bounded by the exterior surfaces 156 of the belts 108 that lie between the entrance and the exit of the casting cavity 150 at any particular point in time. The path of these exterior surfaces 156 can be adjusted, such as by pushing against them from within the top and bottom belt assemblies 102, 104 (e.g., from opposite the belts 108 from the casting cavity 150). As depicted in FIG. 1, a proximal support 110 and a distal support 112 are located within each of the top and bottom belt assemblies 102, 104. The proximal support 110 and the distal support 112 can physically contact the belt 108 to define the path of the belt 108 and therefore the path of the exterior surface 156 of the belt 108. The path of the exterior surfaces 156 of the belts 108 of the top and bottom belt assemblies 102, 104 define a convergence profile for the casting cavity 150.

The convergence profile is a representation of the height of the casting cavity 150 (e.g., distance between the exterior surfaces 156 of the belts 108) across the length of the casting cavity 150 (e.g., longitudinal distance of the casting cavity 150 along direction 154). Since the proximal support 110 and the distal support 112 are individually adjustable, the convergence profile of the casting cavity can have multiple zones, such as a proximal zone (e.g., a first zone) with a high, positive rate of convergence (e.g., quickly moving from a large height to a smaller height) and a distal zone (e.g., a second zone) with a low, negative rate of convergence (e.g., slowly moving from a first height to a slightly larger height).

In some cases, an optional controller 158 can be used to control the movement of the proximal support 110 and/or the distal support 112, such as before and/or during a casting process. Controller 158 can be coupled to actuators associated with the proximal support 110 and/or the distal support 112. Control paths from the controller 158 to the supports 110, 112 are not depicted in FIG. 1 for clarity purposes. In some cases, each of the proximal support 110 and the distal support 112 is controllable by the controller 158. However, in some cases, only the proximal support 110 is controllable by the controller 158, and the distal support 112 is otherwise secured in place (e.g., prior to a casting process). By adjusting the position of the proximal support 110 and optionally the distal support 112, the controller 158 can make adjustments to the convergence profile of the casting cavity 150.

In some cases, the controller 158 can make adjustments to the convergence profile based on stored convergence profile information, with or without dynamic feedback. For example, controller 158 can have preset or modeled convergence profile information for a combination of particular casting parameters. Examples of casting parameters include alloy selection, as-cast continuously cast article height, and casting speed, although other casting parameters may be used. Preset convergence profile information can include convergence profile information that has been previously generated for a set of casting parameters and stored for later use. Modeled convergence profile information can include convergence profile information that is generated on demand based on inputted casting parameters. Convergence profile information can include initial settings for a convergence profile (e.g., for setting the convergence profile prior to a casting process) and optionally one or more additional settings for adjustments to the convergence profile during a casting process.

In some cases, the controller 158 can make dynamic changes to the convergence profile based on live feedback. Feedback can originate from various sensors and other equipment. For example, feedback related to casting speed can come from motors associated with the belts 108. In some cases, sensors 160 can be coupled to the controller 158. Sensors 160 can be temperature sensors or other types of sensors. Sensors 160 can provide live data to the controller 158 regarding the casting process, such as temperature of the belts 108, exit temperature of the continuously cast article 106, and/or other data. Sensors 160 can be placed in any suitable location, such as within a belt assembly 102, 104 or adjacent the continuously cast article 106 near the exit of the casting cavity 150.

Figure 2:
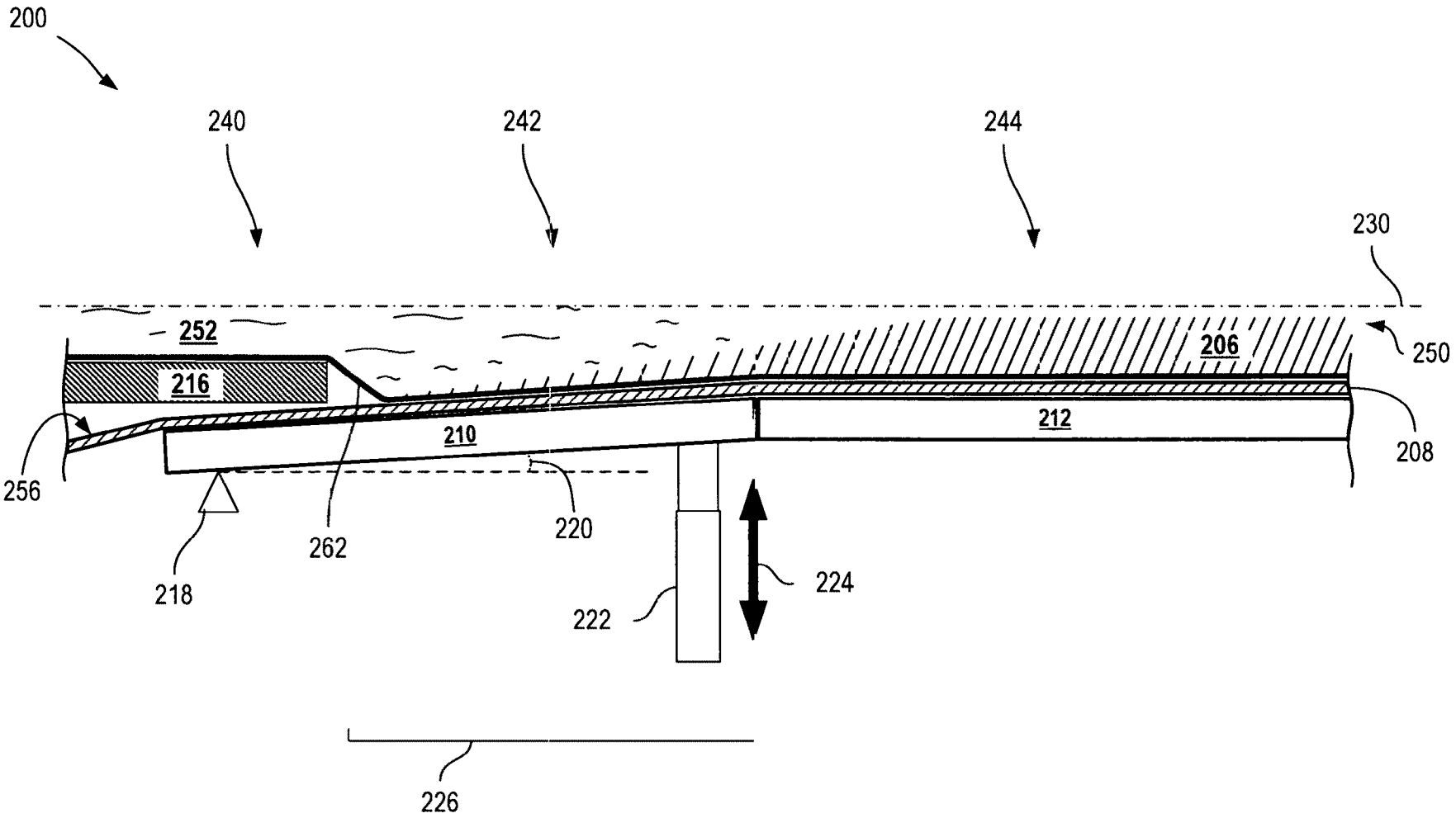
FIG. 2 is a side view schematic diagram depicting the bottom half of a casting cavity of a continuous casting device according to certain aspects of the present disclosure.

FIG. 2 is a side view schematic diagram depicting the bottom half of a casting cavity 250 of a continuous casting device 200 according to certain aspects of the present disclosure. The continuous casting device 200 can be the continuous casting device 100 of FIG. 1. The continuous casting device 200 is described in FIG. 2 as having cooling pads (e.g., proximal cooling pad 210 and distal cooling pad 212), however in some cases, the continuous casting device 200 may use supports that are not cooling pads for one or both of the proximal cooling pad 210 and distal cooling pad 212.

The bottom of the casting cavity 250 can be defined by the exterior surface 256 of the belt 208 of the bottom belt assembly. The casting cavity 250 can have a centerline 230 that extends through the center of the casting cavity 250 in a casting direction. A center plane of the casting cavity 250 can be defined by the centerline 230 and a lateral width of the casting cavity 250 (e.g., into and out of the page as seen in FIG. 2).

A nosepiece 216 of a nozzle (e.g., nozzle 114 of FIG. 1) can dispense liquid metal 252 into the casting cavity 250. The liquid metal 252 can exit the nosepiece 216 and start to fill the casting cavity 250, contacting the external surface 256 of the belt 208. A meniscus 262 can form in the liquid metal 252 between the nosepiece 216 of the nozzle and the external surface 256 of the belt 208. As the liquid metal 252 cools, it begins to solidify, until it has become a solid, continuously cast article 206 (e.g., a metal strip). A solidification distance 226 exists between where the liquid metal 252 first contacts the belt 208 and where the liquid metal 252 has fully solidified or has solidified sufficiently such that little or no solidification shrinkage will occur thereafter.

A liquid zone 240 can exist before the liquid metal 252 has solidified by any appreciable amount (e.g., less than 1%, 1.1%, 1.2%, 1.3%, 1.4%, 1.5%, 1.6%, 1.7%, 1.8%, 1.9%, or 2% solid). A solid zone 244 can exist where the liquid metal 252 has substantially solidified (e.g., at least 75%, 80%, 85%, 90%, or 95% solid) or fully solidified (e.g., at least 95%, 96%, 97%, 98%, 99% solid). A solidification zone 242 can exist between the liquid zone 240 and the solid zone 244. The solidification distance 226 may be approximately or exactly the length of the solidification zone 242. In some cases, the proximal cooling pad 210 exists in the solidification zone 242 and the distal cooling pad 212 exists in the solid zone 244.

A proximal cooling pad 210 can contact the belt 208. As used herein, the term "contact" when used with respect to a cooling pad contacting a belt can include contacting the belt through a layer of cooling fluid. The proximal cooling pad 210 can be positioned to displace the belt 208 from its otherwise expected path of travel. The proximal cooling pad 210 can be actuated to adjust the path of the belt 208 as desired. A distal cooling pad 212 can also contact the belt 208 and can also displace the belt 208 from its otherwise expected path of travel. In some cases, the distal cooling pad 212 can be actuated to adjust the path of the belt 208 as desired. In such cases, the distal cooling pad 212 can include associated elements to control its adjustment, as depicted with respect to the proximal cooling pad 210.

As depicted in FIG. 2, the proximal cooling pad 210 can be fixed about a pivot point 218. Extension and/or retraction of actuator 222 in direction 224 can adjust an angle of attack 220 of the proximal cooling pad 210. The angle of attack 220 can be an angle between the belt-contacting surface of the proximal cooling pad 210 and the centerline 230 (e.g., horizontal, in some cases). By extending or retracting actuator 222, the angle of attack of the exterior surface 256 of the belt 208 can be adjusted due to the displacement of the belt 208 by the proximal cooling pad 210. Thus, the proximal cooling pad 210 can be pivoted and the convergence profile and rate of convergence of the casting cavity 250 can be adjusted. Based on the casting parameters (e.g., alloy of the liquid metal 252, casting speed, or others), the angle of attack 220 of the proximal cooling pad 210 can be adjusted to account for solidification shrinkage that occurs within a solidification zone 242. Accounting for this solidification shrinkage can allow the surface of the solidifying metal to remain in contact with the external surface 256 of the belt 208. In some cases, the proximal cooling pad 210 extends from at or upstream of the casting cavity 250 (e.g., at or upstream of the exit of the nosepiece 216) to the end of the solidification distance 226. In some cases, the proximal cooling pad 210 can end upstream or downstream of the end of the solidification distance 226.

FIG. 2 depicts the proximal cooling pad 210 having an upstream pivot point 218 and a downstream actuator 222, however any suitable combination and placement of actuators 222 and/or pivot points 218 can be used to achieve the desired actuatability of the proximal cooling pad 210. For example, a proximal cooling pad 210 can be supported by multiple actuators 222 designed to operate independently to achieve a desirable angle of attack 220.

In some cases, the proximal cooling pad 210 can further be adjustable in a longitudinal direction (e.g., in the casting direction). The top half of the continuous casting device 200 can be designed similarly to the bottom half as depicted and disclosed in FIG. 2. In some cases, adjustments to the top and bottom cooling surfaces can be symmetric. However, in some cases, adjustments to the top and bottom cooling surfaces can be asymmetric to account for the asymmetric effects of gravity and heat flow.

As described herein, the distal cooling pad 212 can be fixed or adjustable similarly to the proximal cooling pad 210. The proximal cooling pad 210 can be adjusted to account for solidification shrinkage that occurs within the solidification zone 242. The distal cooling pad 212 can be fixed or adjustable to a position that results in a desired exit temperature of the continuously cast article 206. It can be desirable to achieve a particular exit temperature to facilitate downstream processing and minimize the need for extra equipment, such as cooling device and heating devices.

Figure 3:
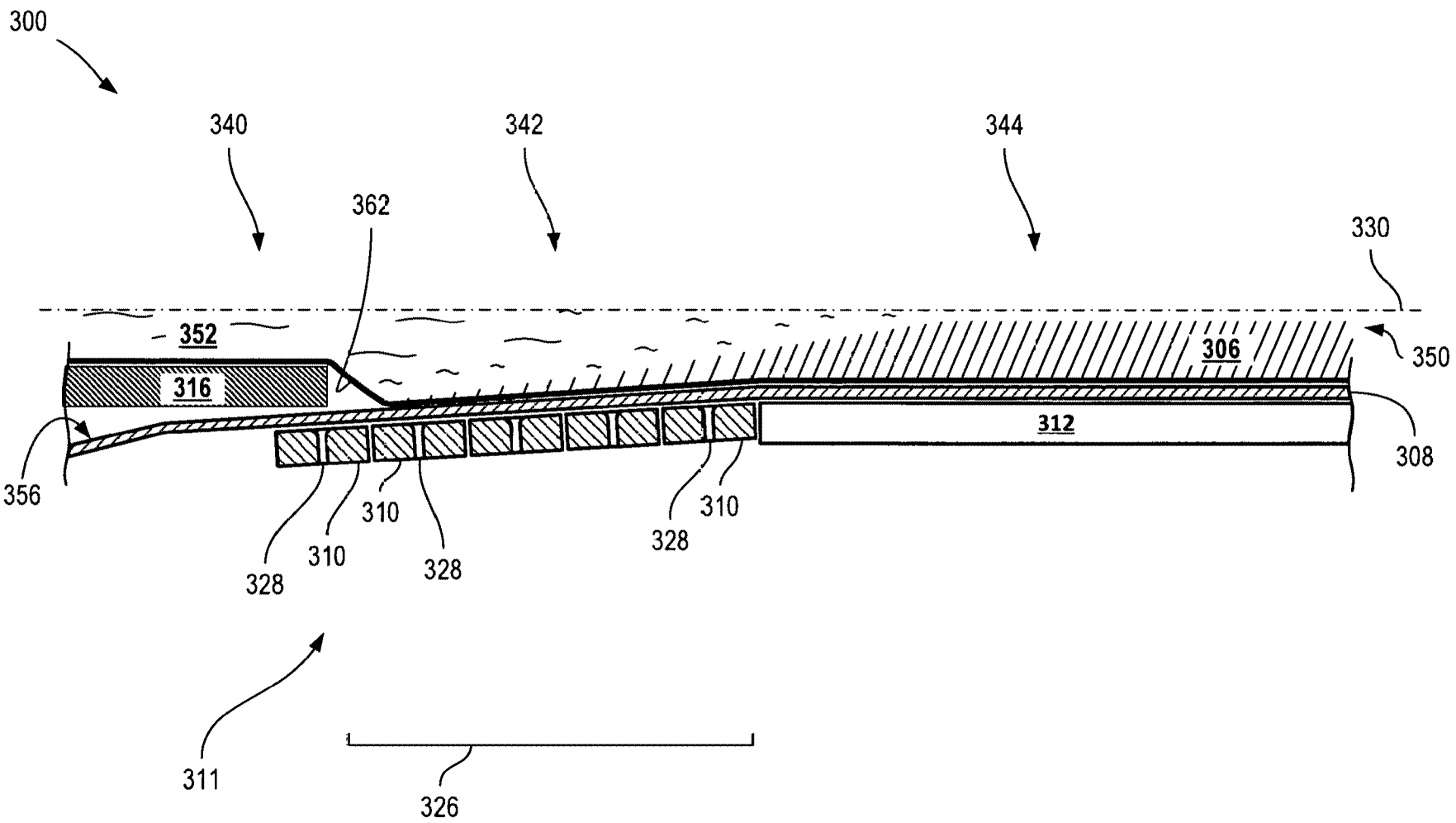
FIG. 3 is a side view schematic diagram depicting the bottom half of a casting cavity of a continuous casting device with linear nozzle cooling pads according to certain aspects of the present disclosure.

FIG. 3 is a side view schematic diagram depicting the bottom half of a casting cavity 350 of a continuous casting device 300 with linear nozzle cooling pads according to certain aspects of the present disclosure. The continuous casting device 300 can be the continuous casting device 100 of FIG. 1. The continuous casting device 300 is described in FIG. 3 as having cooling pads (e.g., proximal cooling pad set 311 containing linear nozzles 310, and distal cooling pad 312), however in some cases, the continuous casting device 300 may use supports that are not cooling pads instead of any of the linear nozzles 310, proximal cooling pad set 311, or distal cooling pad 312.

The bottom of the casting cavity 350 can be defined by the external surface 356 of the belt 308 of the bottom belt assembly. The casting cavity 350 can have a centerline 330 that extends through the center of the casting cavity 350 in a casting direction. A center plane of the casting cavity 350 can be defined by the centerline 330 and a lateral width of the casting cavity 350 (e.g., into and out of the page as seen in FIG. 3).

A nosepiece 316 of a nozzle (e.g., nozzle 114 of FIG. 1) can dispense liquid metal 352 into the casting cavity 350. The liquid metal 352 can exit the nosepiece 316 and start to fill the casting cavity 350, contacting the external surface 356 of the belt 308. A meniscus 362 can form in the liquid metal 352 between the nosepiece 316 of the nozzle and the external surface 356 of the belt 308. As the liquid metal 352 cools, it begins to solidify, until it has become a solid, continuously cast article 306 (e.g., a metal strip). A solidification distance 326 exists between where the liquid metal 352 first contacts the belt 308 and where the liquid metal 352 has fully solidified or has solidified sufficiently such that little or no solidification shrinkage will occur thereafter.

A liquid zone 340 can exist before the liquid metal 352 has solidified by any appreciable amount (e.g., less than 1%, 1.1%, 1.2%, 1.3%, 1.4%, 1.5%, 1.6%, 1.7%, 1.8%, 1.9%, or 2% solid). A solid zone 344 can exist where the liquid metal 352 has substantially solidified (e.g., at least 75%, 80%, 85%, 90%, or 95% solid) or fully solidified (e.g., at least 95%, 96%, 97%, 98%, 99% solid). A solidification zone 342 can exist between the liquid zone 340 and the solid zone 344. The solidification distance 326 may be approximately or exactly the length of the solidification zone 342. In some cases, a proximal cooling pad set 311 exists in the solidification zone 342 and the distal cooling pad 312 exists in the solid zone 344.

The proximal cooling pad set 311 can include two or more proximal cooling pads that contact the belt 308. As depicted in FIG. 3, the proximal cooling pad set 311 includes five cooling pads that are linear nozzles 310, although other numbers of cooling pads and other styles of cooling pads may be used. The linear nozzles 310 can be positioned to displace the belt 308 from its otherwise expected path of travel. Each of the linear nozzles 310 can be actuated to adjust the path of the belt 308 as desired at individual locations within the solidification zone 342. A distal cooling pad 312 can also contact the belt 308 and can also displace the belt 308 from its otherwise expected path of travel. In some cases, the distal cooling pad 312 can be actuated to adjust the path of the belt 308 as desired. In such cases, the distal cooling pad 312 can include associated elements to control its adjustment, as described herein, such as with respect to the proximal cooling pad 210 of FIG. 2.

As depicted in FIG. 3, the proximal cooling pad set 311 includes multiple linear nozzles 310. In some cases, each of the linear nozzles 310 is fixed with respect to one another and the entire proximal cooling pad set 311 can be actuated as a whole, such as using any of the equipment and techniques for actuating proximal cooling pad 210 of FIG. 2. In some cases, some or each of the linear nozzles 310 can be individually adjustable to adjust the path of the belt 308 and therefore adjust the convergence profile of the casting cavity 350. Each of the linear nozzles 310 can be coupled to an associated actuator (e.g., similar to actuator 222 of FIG. 2) capable of adjusting the position of the linear nozzle 310, and thus the path of travel of the belt 308. Thus, the convergence profile and rate of convergence of the casting cavity 350 can be adjusted. Based on the casting parameters (e.g., alloy of the liquid metal 352, casting speed, or others), the position of each of the linear nozzles 310 can be adjusted to account for solidification shrinkage that occurs within a solidification zone 342. Accounting for this solidification shrinkage can allow the surface of the solidifying metal to remain in contact with the external surface 356 of the belt 308. Because of the increased resolution available to a proximal cooling pad set 311 over a single proximal cooling pad, several different convergence rates can be present in the convergence profile in the solidification zone 342. In some cases, the proximal cooling pad set 311 extends from at or upstream of the casting cavity 350 (e.g., at or upstream of the exit of the nosepiece 316) to the end of the solidification distance 326. In some cases, the proximal cooling pad set 311 can end upstream or downstream of the end of the solidification distance 326.

In some cases, each, some, or all of the linear nozzles 310 can further be adjustable in a longitudinal direction (e.g., in the casting direction). The top half of the continuous casting device 300 can be designed similarly to the bottom half as depicted and disclosed in FIG. 3. In some cases, the convergence profile of the casting cavity 350 can be symmetric along the centerline 330. However, in some cases, the convergence profile of the casting cavity 350 is not symmetric along the centerline 330 to account for the asymmetric effects of gravity and heat flow.

As described herein, the distal cooling pad 312 can be fixed or adjustable similarly to the proximal cooling pad set 311. In some cases, a distal cooling pad set can be used, comprising two or more individual cooling pads, such as linear nozzles. The proximal cooling pad set 311 can be adjusted to account for solidification shrinkage that occurs within the solidification zone 342. The distal cooling pad 312 can be fixed or adjustable to a position that results in a desired exit temperature of the continuously cast article 306. It can be desirable to achieve a particular exit temperature to facilitate downstream processing and minimize the need for extra equipment, such as cooling device and heating devices.

Figure 4:
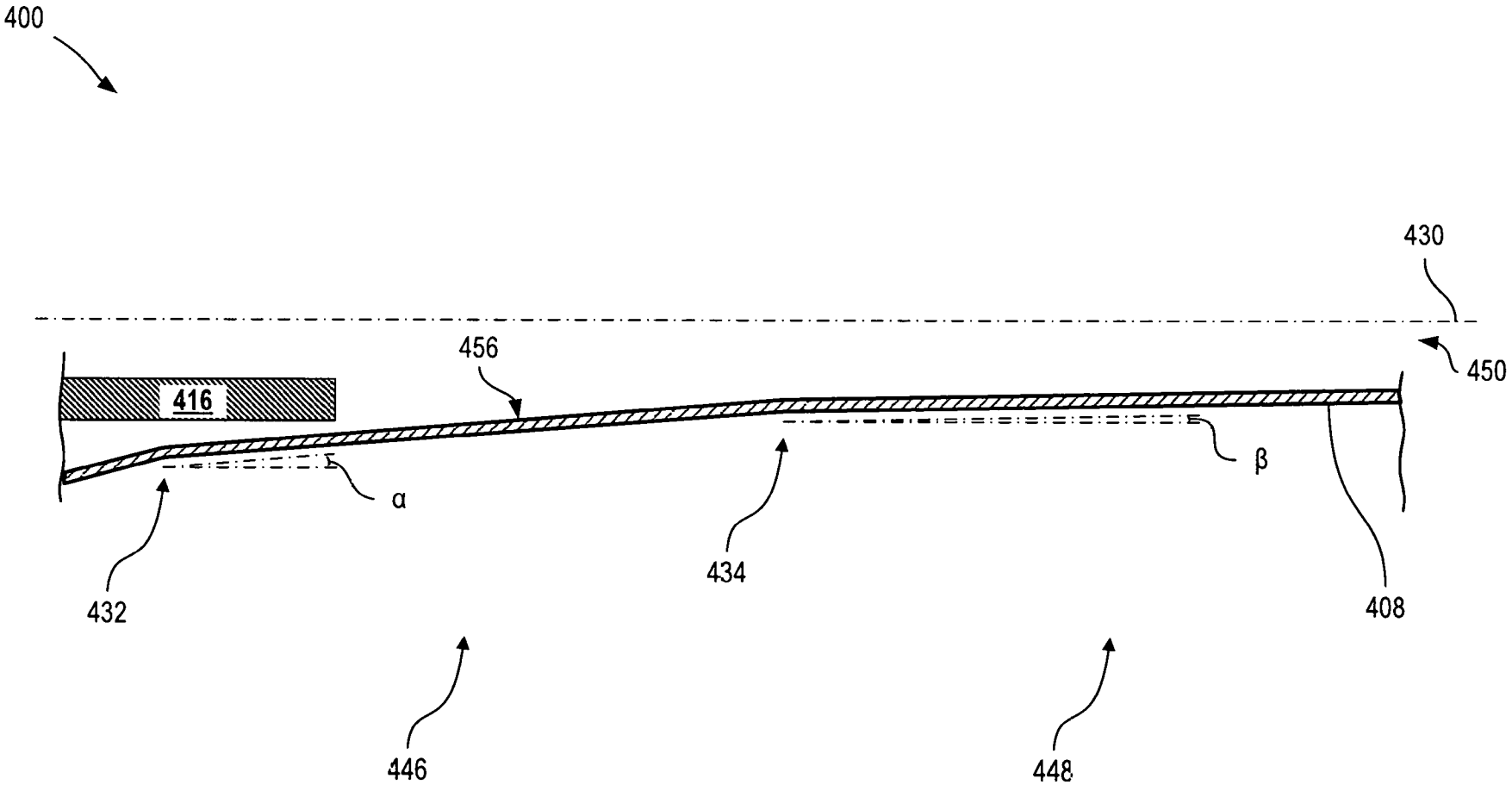
FIG. 4 is a side view schematic diagram depicting the bottom half of a casting cavity of a continuous casting device illustrating angles of attack according to certain aspects of the present disclosure.

FIG. 4 is a side view schematic diagram depicting the bottom half of a casting cavity 450 of a continuous casting device 400 illustrating angles of attack according to certain aspects of the present disclosure. The continuous casting device 400 can be the continuous casting devices 100, 200, or 300 of FIG. 1, 2, or 3, respectively. The supports or cooling pads and the solidifying metal are not depicted for illustrative purposes.

The bottom of the casting cavity 450 can be defined by the external surface 456 of the belt 408 of the bottom belt assembly. The casting cavity 450 can have a centerline 430 that extends through the center of the casting cavity 450 in a casting direction. A center plane of the casting cavity 450 can be defined by the centerline 430 and a lateral width of the casting cavity 450 (e.g., into and out of the page as seen in FIG. 4).

A nosepiece 416 of a nozzle (e.g., nozzle 114 of FIG. 1) can dispense liquid metal into the casting cavity 450, which can then fill the casting cavity 450 and solidify as it moves towards the exit of the continuous casting device 400.

The path of travel of the belt 408 can be adjusted to change the convergence profile of the casting cavity 450. Any suitable technique can be used to adjust the path of travel of the belt 408, such as through the use of supports or cooling pads to displace the belt 408, such as described with reference to FIGS. 1-3. In some cases, the path of travel of the belt 408 can be adjusted using other adjustable surfaces, such as low-friction surfaces or rolling surfaces (e.g., rollers).

The belt 408 can be displaced sufficiently to achieve at least two stages, where each stage is associated with a particular convergence profile. The first stage 446 can be used while the solidifying liquid metal is undergoing solidification shrinkage, and therefore can exactly or approximately match the solidification zone 242 of FIG. 2. The second stage 448 can be used after the metal is substantially or completely solidified, and therefore can exactly or approximately match the solid zone 244 of FIG. 2.

The belt 408 can be displaced in the first stage 446 to achieve a first convergence rate. In some cases, the convergence rate is linear during the first stage 446 at an angle of attack $\alpha$. The angle of attack $\alpha$ can be defined as the angle between the centerline 430 and the external surface 456 of the belt 408 in the first stage 446. The belt 408 can be displaced in the second stage 448 to achieve a second convergence rate. In some cases, the convergence rate is linear during the second stage 448 at an angle of attack $\beta$. The angle of attack $\beta$ can be defined as the angle between the centerline 430 and the external surface 456 of the belt 408 in the second stage 448. When accounting for solidification shrinkage, the angle of attack $\alpha$ may be positive and thus the first convergence rate in the first stage 446 is positive (e.g., the height of the casting cavity decreases in the casting direction). In some cases, the angle of attack $\beta$ may be negative and thus the second convergence rate in the second stage 448 is negative (e.g., the height of the casting cavity increases in the casting direction). However, in some cases, as depicted in FIG. 4, the angle of attack $\beta$ may still be positive, although it may be smaller than angle of attack $\alpha$. The cooling pads or other actuatable surfaces may pivot about a first stage pivot point 432 to achieve the desired angle of attack $\alpha$ in the first stage 446 and pivot about a second stage pivot point 434 to achieve the desired angle of attack $\beta$ in the second stage 448.

In some cases, the convergence profiles may include more than two zones. In some cases, the convergence profile within a zone may include a non-linear profile (e.g., a non-linear rate).

Figure 5:
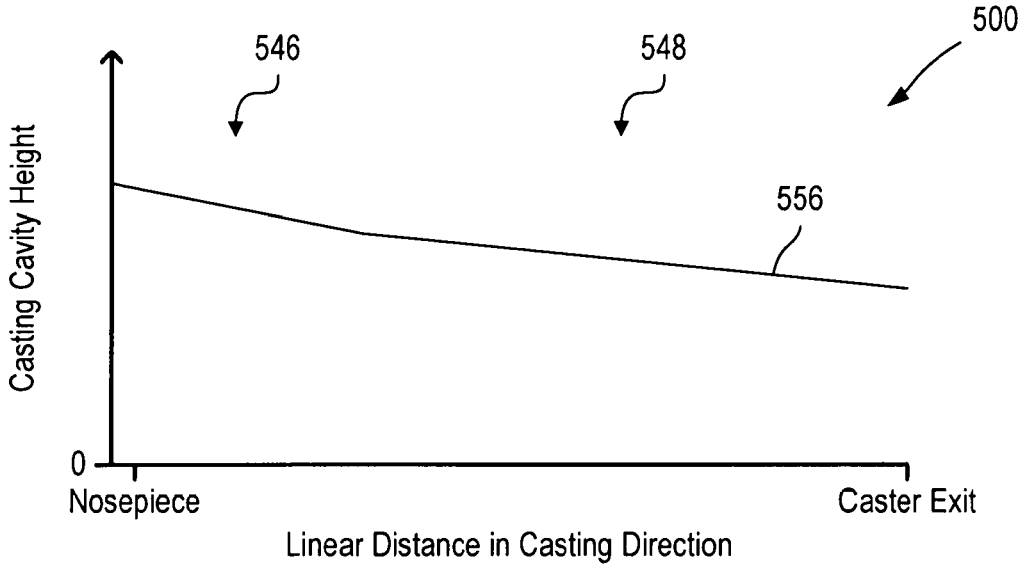
FIG. 5 is a graphical depiction of a convergence profile that is monotonically decreasing according to certain aspects of the present disclosure.

FIG. 5 is a graphical depiction of a convergence profile 500 that is monotonically decreasing according to certain aspects of the present disclosure. The convergence profile 500 depicts the casting cavity height between the nosepiece and the exit of the casting cavity. The casting cavity height is the distance between the cooling surfaces (e.g., continuous belts) of the continuous casting device. Line 556 represents the surface of a belt, such as the external surface 256 of belt 208 of FIG. 2. The convergence profile during a first stage 546 (e.g., during solidification to account for solidification shrinkage) is different than the convergence profile during a second stage 548 (e.g., after solidification).

Line 556 decreases linearly in the first stage 546 at a first rate and further decreases in the second stage 548 a different rate. The decrease in casting cavity height corresponds to a positive convergence rate, since the height decreases as the belts converge. The casting cavity height can decrease monotonically between the nosepiece and the caster exit. The rate of decrease of the casting cavity height during the first stage 546 can be larger than the rate of decrease during the second stage 548.

Figure 6:
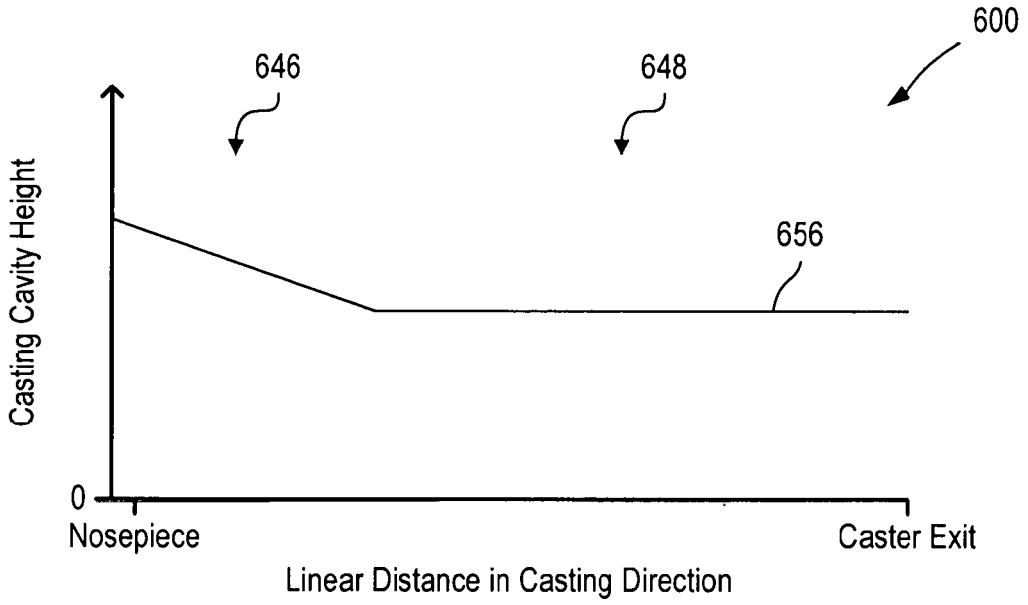
FIG. 6 is a graphical depiction of a convergence profile that includes a constant second stage according to certain aspects of the present disclosure.

FIG. 6 is a graphical depiction of a convergence profile 600 that includes a constant second stage 648 according to certain aspects of the present disclosure. The convergence profile 600 depicts the casting cavity height between the nosepiece and the exit of the casting cavity. The casting cavity height is the distance between the cooling surfaces (e.g., continuous belts) of the continuous casting device. Line 656 represents the surface of a belt, such as the external surface 256 of belt 208 of FIG. 2. The convergence profile during a first stage 646 (e.g., during solidification to account for solidification shrinkage) is different than the convergence profile during a second stage 648 (e.g., after solidification).

Line 656 decreases linearly in the first stage 646 at a first rate and then remains constant during the second stage 648. The decrease in casting cavity height corresponds to a positive convergence rate, since the height decreases as the belts converge. The casting cavity height can decrease monotonically during the first stage 646 and then remain constant throughout the second stage 648.

Figure 7:
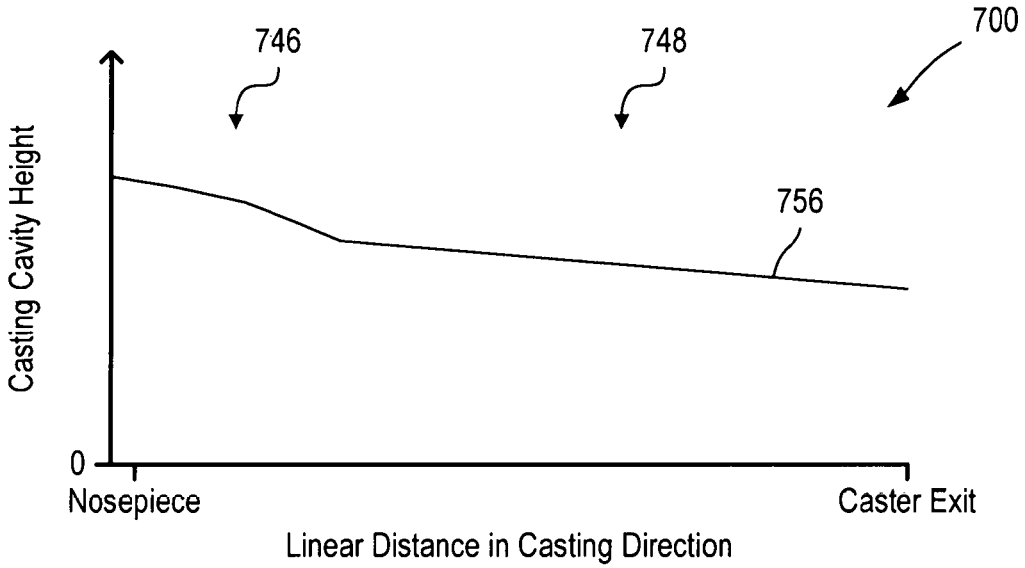
FIG. 7 is a graphical depiction of a convergence profile that includes a multi-part first stage according to certain aspects of the present disclosure.

FIG. 7 is a graphical depiction of a convergence profile 700 that includes a multi-part first stage 746 according to certain aspects of the present disclosure. The convergence profile 700 depicts the casting cavity height between the nosepiece and the exit of the casting cavity. The casting cavity height is the distance between the cooling surfaces (e.g., continuous belts) of the continuous casting device. Line 756 represents the surface of a belt, such as the external surface 256 of belt 208 of FIG. 2. The convergence profile during a first stage 746 (e.g., during solidification to account for solidification shrinkage) is different than the convergence profile during a second stage 748 (e.g., after solidification).

Line 756 decreases in the first stage 746 at multiple, different rates before further decreasing in the second stage 748. The decrease in casting cavity height corresponds to a positive convergence rate, since the height decreases as the belts converge. The convergence profile 700 can be achieved using multiple proximal cooling pads or a proximal cooling pad set, such as described with reference to FIG. 3. The rate of decrease of the casting cavity height can change according to the amount of solidification shrinkage occurring at respective longitudinal locations within the first stage 746. The casting cavity height during the second stage 748 can be adjusted as necessary, such as decreasing at a linear rate.

Figure 8:
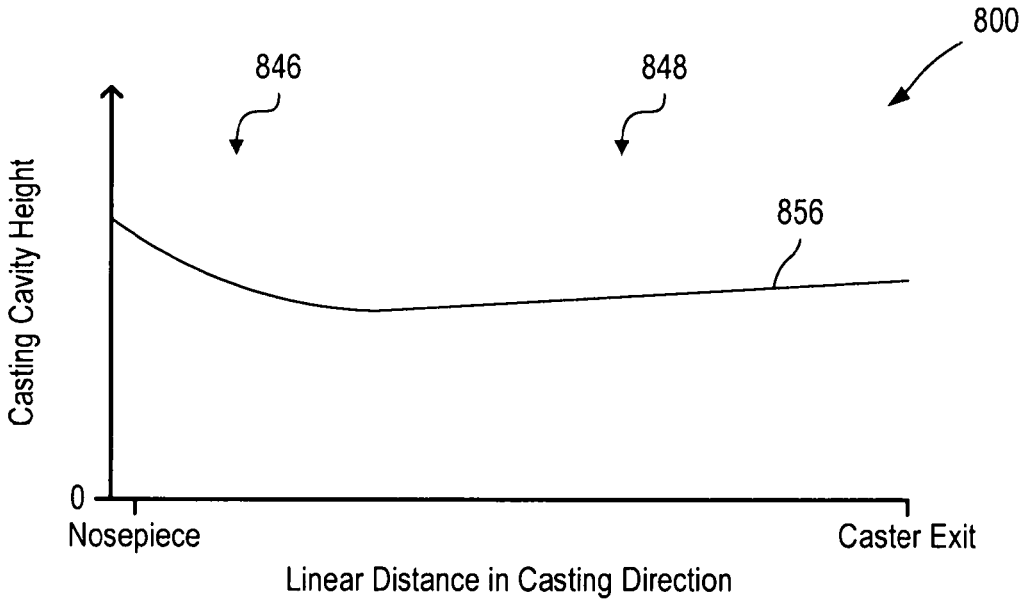
FIG. 8 is a graphical depiction of a convergence profile that depicts a non-linear first stage and an increasing second stage according to certain aspects of the present disclosure.

FIG. 8 is a graphical depiction of a convergence profile 800 that depicts a non-linear first stage 846 and an increasing second stage 848 according to certain aspects of the present disclosure. The convergence profile 800 depicts the casting cavity height between the nosepiece and the exit of the casting cavity. The casting cavity height is the distance between the cooling surfaces (e.g., continuous belts) of the continuous casting device. Line 856 represents the surface of a belt, such as the external surface 256 of belt 208 of FIG. 2. The convergence profile during a first stage 846 (e.g., during solidification to account for solidification shrinkage) is different than the convergence profile during a second stage 848 (e.g., after solidification).

Line 856 decreases in the first stage 846 at a gradually decreasing rate before increasing in the second stage 848. The decrease in casting cavity height corresponds to a positive convergence rate, since the height decreases as the belts converge. The increase in casting cavity height corresponds to a negative convergence rate, since the height increases as the belts diverge. The convergence profile 800 in the first stage 846 can be achieved using multiple proximal cooling pads or a proximal cooling pad set, such as described with reference to FIG. 3. In some cases, the convergence profile 800 in the first stage 846 can be achieved using one or more proximal cooling pads having a non-linear surface exposed to the inner surface of the belt. For example, a cooling pad can be shaped to achieve a desired convergence profile. Such cooling pad can be further actuated to adjust the convergence profile as necessary.

As depicted in FIG. 8, the height of the casting cavity can increase during the second stage 848. This type of negative convergence (e.g., increase in casting cavity height) during the second stage 848 can be used in any of the other convergence profiles disclosed herein, such as convergence profiles 500, 600, 700, of FIGS. 5, 6, 7, respectively. In some cases, this type of negative convergence can be used to achieve a desirable exit temperature of the continuously cast article as it exits the continuous casting device.

Figure 9:
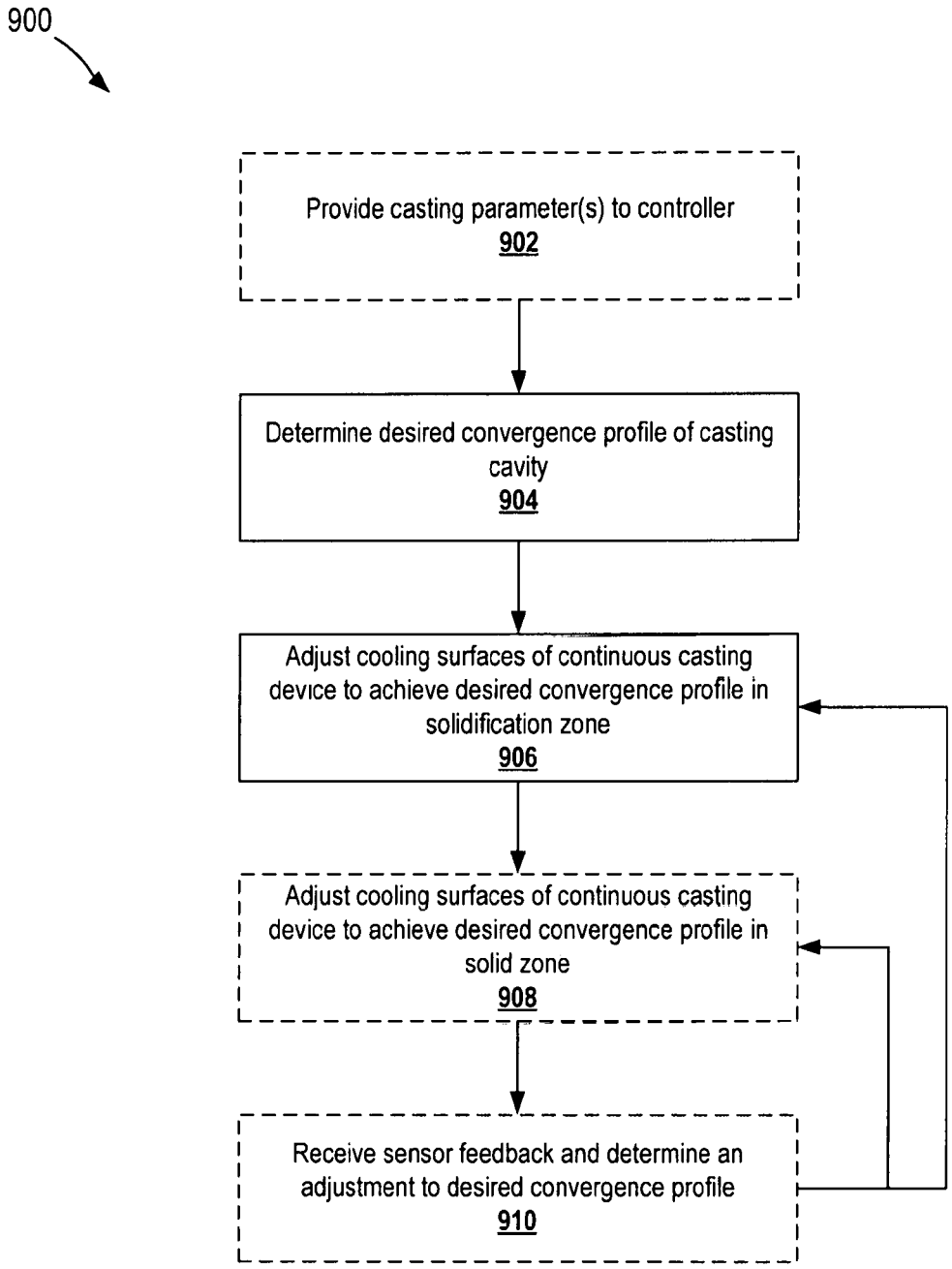
FIG. 9 is a flowchart depicting a process for adjusting a continuous casting device having multiple convergence stages according to certain aspects of the present disclosure.

FIG. 9 is a flowchart depicting a process 900 for adjusting a continuous casting device having multiple convergence stages according to certain aspects of the present disclosure. The process 900 can be used to make adjustments to the continuous casting device 100 of FIG. 1, or any suitable continuous casting device.

At optional block 902, one or more casting parameters are provided to a controller. The controller can be any suitable device for controlling the actuators, as described herein, such as a processor, microprocessor, proportional-integral-derivative controller, proportional controller, or the like. Instructions for performing the actions performable by the controller, as well as any data accessible to the controller (e.g., stored convergence profiles), can be stored on one or more non-transitory machine-readable storage mediums or storage devices which can comprise, without limitation, local and/or network accessible storage, and/or can include, without limitation, a disk drive, a drive array, an optical storage device, a solid-state storage device such as a random access memory ("RAM") and/or a read-only memory ("ROM"), which can be programmable, flash-updateable and/or the like.

At block 904, the desired convergence profile of the casting cavity can be determined. Determining the desired convergence profile can include retrieving a preset convergence profile using the casting parameter(s) provided at block 902. Determining the desired convergence profile can include calculating, modeling, or estimating the desired convergence profile using the casting parameter(s) provided at block 902. In some cases, determining the desired convergence profile can include starting from a generic, preset convergence profile generally acceptable for use with the continuous casting device associated with process 900. In some cases, determining the desired convergence profile can include accessing current data associated with the continuous casting device or molten metal to be fed to the continuous casting device, such as through one or more sensors coupled to the controller.

At block 906, the cooling surfaces of the continuous casting device are adjusted to achieve the desired convergence profile in the solidification zone. Block 906 can include adjusting the proximal support or proximal cooling pad, such as proximal support 110 of FIG. 1. In some cases, adjusting the proximal support or proximal cooling pad can include adjusting at least one of a proximal cooling pad set, such as at least one linear nozzle 328 of the proximal cooling pad set 311 of FIG. 3. The adjustment performed at block 906 can result in a convergence profile of the casting cavity suitable to achieve continuous contact between the solidifying metal within the casting cavity and the cooling surfaces of the continuous casting device, despite solidification shrinkage.

At optional block 908, the cooling surfaces of the continuous casting device are adjusted to achieve the desired convergence profile in at least a portion of the solid zone. Block 908 can include adjusting a distal support or distal cooling pad, such as distal support 112 of FIG. 1. In some cases, adjusting the distal support or distal cooling pad can include adjusting at least one of a distal cooling pad set. The adjustment performed at block 908 can result in a convergence profile of the casting cavity suitable to achieve a desirable exit temperature of the continuously cast article exiting the continuous casting device. In some cases, the amount of adjustment needed at block 908 can depend on the adjustment made at block 906. The adjustment at block 908 can occur simultaneously or sequentially with respect to the adjustment at block 906.

At optional block 910, sensor data can be received by the controller and used to determine an adjustment to the desired convergence profile. The determined adjustment can then be fed into block 906 and/or block 908 to adjust the convergence profile of the casting cavity. In some cases, the sensor data received at block 910 is temperature data associated with at least one of the casting cavity, the cooling assemblies (e.g., the cooling surfaces), and the continuously cast article as it exits the continuous casting device.

In some cases, sensor data related to the temperature of the casting cavity or the cooling surfaces, or sensor data related to the surface quality of the continuously cast article, can be used to make adjustments to the convergence profile in the solidification zone, while sensor data related to the temperature of the continuously cast article as it exits the continuous casting device can be used to make adjustments to the convergence profile in at least a portion of the solid zone.

In some cases, convergence can be indirectly monitored by measuring heat flux profiles using an array of thermocouples mounted at, near, or in the proximal cooling pad and/or the distal cooling pad(s). The array of thermocouples can include a plurality of thermocouples arranged across a width of the continuous casting device and a longitudinal length of the continuous casting device. The heat flux profile can drop off significantly when the belt loses contact with the solidifying metal. Improved contact with the cooling surface can be manifested as a smoother heat flux profile. Thus, feedback from the array of thermocouples can be used to provide feedback for making adjustments to the proximal cooling pad and optionally any distal cooling pads.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is a metal casting system comprising: an opposing pair of cooling assemblies defining a casting cavity therebetween, the casting cavity extending longitudinally between a proximal end and a distal end; and a nozzle positioned at the proximal end of the casting cavity for feeding molten metal into the casting cavity, wherein the opposing pair of cooling assemblies each comprise a cooling surface made of a thermally conductive material for extracting heat from the molten metal to solidify the molten metal as the molten metal travels towards the distal end of the casting cavity; wherein each of the opposing pair of cooling assemblies includes: at least one proximal cooling pad positioned opposite the cooling surface from the casting cavity for displacing the cooling surface, wherein the at least one proximal cooling pad is longitudinally positioned adjacent to the proximal end of the casting cavity, and wherein the at least one proximal cooling pad is movable to adjust a convergence profile of the casting cavity in a proximal zone of the casting cavity; and at least one distal cooling pad positioned opposite the cooling surface from the casting cavity for displacing the cooling surface, wherein the at least one distal cooling pad is longitudinally positioned between the at least one proximal cooling pad and the distal end of the casting cavity.

Example 2 is the metal casting system of example 1, wherein the at least one distal cooling pad is movable to adjust a convergence profile of the casting cavity in a distal zone of the casting cavity between the proximal zone and a distal end of the casting cavity.

Example 3 is the metal casting system of examples 1 or 2, wherein the at least one proximal cooling pad is pivotable to adjust the convergence profile of the casting cavity.

Example 4 is the metal casting system of examples 1-3, wherein the at least one proximal cooling pad includes a plurality of proximal cooling pads, and wherein each of the plurality of proximal cooling pads is individually adjustable to adjust the convergence profile of the casting cavity.

Example 5 is the metal casting system of examples 1-4, wherein the at least one proximal cooling pad is coupled to at least one actuator for adjusting the convergence profile of the casting cavity during a casting process.

Example 6 is the metal casting system of examples 1-5, wherein the at least one proximal cooling pad includes a plurality of linear nozzles extending laterally across a width of the cooling surface.

Example 7 is the metal casting system of examples 1-6, wherein each of the cooling surfaces is a continuous metal belt.

Example 8 is the metal casting system of examples 1-7, wherein the at least one distal cooling pad is longitudinally spaced apart from the proximal end of the casting cavity by at least a distance at which the molten metal has solidified.

Example 9 is a continuous casting apparatus comprising: an opposing pair of cooling assemblies defining a casting cavity therebetween, the casting cavity extending longitudinally between a proximal end for accepting molten metal and a distal end for outputting solidified metal, wherein each of the cooling assemblies comprises a cooling surface made of a thermally conductive material for extracting heat from the molten metal to form the solidified metal, and wherein each of the cooling assemblies comprises: at least one proximal support positioned opposite the cooling surface from the casting cavity for displacing the cooling surface, wherein the at least one proximal support is longitudinally positioned adjacent to the proximal end of the casting cavity, and wherein the at least one proximal support is movable to adjust a convergence profile of the casting cavity in a proximal zone of the casting cavity; and at least one distal support positioned opposite the cooling surface from the casting cavity for displacing the cooling surface, wherein the at least one distal support is longitudinally positioned between the at least one proximal support and the distal end of the casting cavity.

Example 10 is the continuous casting apparatus of example 9, wherein the at least one distal support is movable to adjust a convergence profile of the casting cavity in a distal zone of the casting cavity between the proximal zone and a distal end of the casting cavity.

Example 11 is the continuous casting apparatus of examples 9 or 10, wherein the at least one proximal support is pivotable to adjust the convergence profile of the casting cavity.

Example 12 is the continuous casting apparatus of examples 9-11, wherein the at least one proximal support includes a plurality of proximal supports, and wherein each of the plurality of proximal supports is individually adjustable to adjust the convergence profile of the casting cavity.

Example 13 is the continuous casting apparatus of examples 9-12, wherein the at least one proximal support is coupled to at least one actuator for adjusting the convergence profile of the casting cavity during a casting process.

Example 14 is the continuous casting apparatus of examples 9-13, wherein at least one of the at least one proximal support and the at least one distal support includes a cooling pad for extracting heat from the cooling surface.

Example 15 is the continuous casting apparatus of examples 9-14, wherein each of the cooling surfaces is a continuous metal belt.

Example 16 is a method of continuous casting comprising: providing molten metal to a casting cavity between an opposing pair of cooling assemblies at a proximal end of the casting cavity; extracting heat from the molten metal to solidify the molten metal into a solidified metal exiting at a distal end of the casting cavity; adjusting a convergence profile of the casting cavity at a proximal region, wherein the proximal region is adjacent the proximal end of the casting cavity; and adjusting the convergence profile of the casting cavity at a distal region, wherein the distal region is located between the proximal region and a distal end of the casting cavity.

Example 17 is the method of example 16, wherein: adjusting the convergence profile of the casting cavity at the proximal region includes adjusting, for each of the opposing pair of cooling assemblies a proximal angle of attack of a cooling surface of the cooling assembly, wherein the proximal angle of attack defines an orientation of the cooling surface with respect to a centerline of the casting cavity at the proximal region; and adjusting the convergence profile of the casting cavity at the distal region includes adjusting, for each of the opposing pair of cooling assemblies, a distal angle of attack of the cooling surface of the cooling assembly, wherein the distal angle of attack defines an orientation of the cooling surface with respect to a centerline of the casting cavity at the distal region.

Example 18 is the method of examples 16 or 17, wherein: adjusting the convergence profile of the casting cavity at the proximal region includes, for each of the opposing pair of cooling assemblies, moving at least one proximal support, wherein moving the at least one proximal support displaces a cooling surface of the cooling assembly to adjust the convergence profile of the casting cavity at the proximal region; and adjusting the convergence profile of the casting cavity at the distal region includes, for each of the opposing pair of cooling assemblies, moving at least one distal support, wherein moving the at least one distal support displaces the cooling surface of the cooling assembly to adjust the convergence profile of the casting cavity at the distal region.

Example 19 is the method of examples 16-18, further comprising determining a desired casting profile, wherein determining the desired casting profile is based on at least one casting parameter, and wherein adjusting the convergence profile of the casting cavity at the proximal region includes using the desired casting profile.

Example 20 is the method of examples 16-19, wherein adjusting the convergence profile of the casting cavity at the proximal region occurs during a casting process.

Example 21 is the system, apparatus, or method of examples 1-20, wherein the molten metal is an aluminum alloy.

Example 22 is the system, apparatus, or method of examples 1-20, wherein the molten metal is an aluminum alloy having a Magnesium content at or above 8% by weight. In some cases, the Magnesium content is at or above 8.5% by weight. In some cases, the Magnesium content is at or above 9% by weight. In some cases, the Magnesium content is at or above 9.6% by weight.

Example 23 is a continuously cast article made according to the methods of examples 16-22.

What is claimed is:

1. A continuous casting apparatus comprising:

an opposing pair of cooling assemblies defining a casting cavity therebetween, the casting cavity extending longitudinally between a proximal end for accepting molten metal via a nozzle at the proximal end and a distal end for outputting solidified metal, wherein each of the opposing pair of cooling assemblies comprises a cooling surface made of a thermally conductive material for extracting heat from the molten metal to form the solidified metal, and wherein each of the opposing pair of cooling assemblies comprises:

at least one proximal support positioned opposite the cooling surface from the casting cavity for displacing the cooling surface, wherein the at least one proximal support is longitudinally positioned adjacent to the proximal end of the casting cavity, and wherein the at least one proximal support is pivotable about a fulcrum to adjust a convergence profile of the casting cavity in a proximal zone of the casting cavity; and at least one distal support positioned opposite the cooling surface from the casting cavity for displacing the cooling surface, wherein the at least one distal support is longitudinally positioned between the at least one proximal support and the distal end of the casting cavity.

2. The continuous casting apparatus of claim 1, wherein the at least one distal support is movable to adjust a convergence profile of the casting cavity in a distal zone of the casting cavity between the proximal zone and a distal end of the casting cavity.

3. The continuous casting apparatus of claim 1, wherein the at least one proximal support is pivotable to adjust the convergence profile of the casting cavity.

4. The continuous casting apparatus of claim 1, wherein the at least one proximal support is coupled to at least one actuator for adjusting the convergence profile of the casting cavity during a casting process.

5. The continuous casting apparatus of claim 1, wherein at least one of the at least one proximal support and the at least one distal support includes a cooling pad for extracting heat from the cooling surface.

6. The continuous casting apparatus of claim 1, wherein each of the cooling surfaces is a continuous metal belt.

7. A metal casting system comprising:

an opposing pair of cooling assemblies defining a casting cavity therebetween, the casting cavity extending longitudinally between a proximal end and a distal end; and a nozzle positioned at the proximal end of the casting cavity for feeding molten metal into the casting cavity, wherein the opposing pair of cooling assemblies each comprise a cooling surface made of a thermally conductive material for extracting heat from the molten metal within the casting cavity to solidify the molten metal as the molten metal travels towards the distal end of the casting cavity;

wherein each of the opposing pair of cooling assemblies includes:

at least one proximal cooling pad positioned opposite the cooling surface from the casting cavity for displacing the cooling surface, wherein the at least one proximal cooling pad is longitudinally positioned adjacent to the proximal end of the casting cavity, and wherein the at least one proximal cooling pad is pivotable about a fulcrum to adjust a convergence profile of the casting cavity in a proximal zone of the casting cavity; and at least one distal cooling pad positioned opposite the cooling surface from the casting cavity for displacing the cooling surface, wherein the at least one distal cooling pad is longitudinally positioned between the at least one proximal cooling pad and the distal end of the casting cavity.

8. The metal casting system of claim 7, wherein the at least one distal cooling pad is movable to adjust a convergence profile of the casting cavity in a distal zone of the casting cavity between the proximal zone and the distal end of the casting cavity.

9. The metal casting system of claim 7, wherein the at least one proximal cooling pad is coupled to at least one actuator for adjusting the convergence profile of the casting cavity during a casting process.

10. The metal casting system of claim 7, wherein the at least one proximal cooling pad includes a plurality of linear nozzles extending laterally across a width of the cooling surface.

11. The metal casting system of claim 7, wherein each of the cooling surfaces is a continuous metal belt.

12. The metal casting system of claim 7, wherein the at least one distal cooling pad is longitudinally spaced apart from the proximal end of the casting cavity by at least a distance at which the molten metal has solidified.

13. A method of continuous casting comprising:

providing, using a nozzle at a proximal end of a casting cavity, molten metal to the casting cavity between an opposing pair of cooling assemblies at the proximal end of the casting cavity;

extracting, using a cooling surface made of thermally conductive material at each of the opposing pair of cooling assemblies, heat from the molten metal to solidify the molten metal into a solidified metal exiting at a distal end of the casting cavity;

adjusting a convergence profile of the casting cavity at a proximal region, wherein the proximal region is adjacent the proximal end of the casting cavity, and wherein adjusting the convergence profile of the casting cavity at the proximal region includes pivoting at least one proximal support about a fulcrum, wherein pivoting the at least one proximal support displaces a cooling surface of the cooling assembly to adjust the convergence profile of the casting cavity at the proximal region; and adjusting the convergence profile of the casting cavity at a distal region, wherein the distal region is located between the proximal region and a distal end of the casting cavity, and wherein at least one distal support at the distal region displaces the cooling surface of the cooling assembly to adjust the convergence profile of the casting cavity at the distal region.

14. The method of claim 13, wherein:

adjusting the convergence profile of the casting cavity at the proximal region includes adjusting, for each of the opposing pair of cooling assemblies, a proximal angle of attack of a cooling surface of the cooling assembly, wherein the proximal angle of attack defines an orientation of the cooling surface with respect to a centerline of the casting cavity at the proximal region; and adjusting the convergence profile of the casting cavity at the distal region includes adjusting, for each of the opposing pair of cooling assemblies, a distal angle of attack of the cooling surface of the cooling assembly, wherein the distal angle of attack defines an orientation of the cooling surface with respect to a centerline of the casting cavity at the distal region.

15. The method of claim 13, wherein:

adjusting the convergence profile of the casting cavity at the distal region includes, for each of the opposing pair of cooling assemblies, moving the at least one distal support, wherein moving the at least one distal support displaces the cooling surface of the cooling assembly to adjust the convergence profile of the casting cavity at the distal region.

16. The method of claim 13, further comprising determining a desired casting profile, wherein determining the desired casting profile is based on at least one casting parameter, and wherein adjusting the convergence profile of the casting cavity at the proximal region includes using the desired casting profile.

17. The method of claim 13, wherein adjusting the convergence profile of the casting cavity at the proximal region occurs during a casting process.

* * * * *